United States Patent [19]

Baker et al.

[11] 4,312,272

[45] Jan. 26, 1982

[54] DETONATING CORD WITH FLASH-SUPPRESSING COATING

[75] Inventors: James J. Baker; Robert C. Sittig; David A. Ciaramitaro, all of Benson, Ariz.

[73] Assignee: Apache Powder Company, Benson, Ariz.

[21] Appl. No.: 159,255

[22] Filed: Jun. 13, 1980

[51] Int. Cl.[3] ..... C06C 5/04

[52] U.S. Cl. ..... 102/275.8

[58] Field of Search ..... 102/275.8

[56] References Cited

U.S. PATENT DOCUMENTS

| | | | |
|---|---|---|---|
| 2,216,835 | 10/1940 | Carothers | 102/27 R |
| 3,544,360 | 12/1970 | Gardner | 149/11 X |
| 3,740,278 | 6/1973 | Sakreis et al. | 14/11 |
| 4,102,428 | 7/1978 | Kelly et al. | 102/27 R X |
| 4,177,732 | 12/1979 | Steele | 102/27 R |
| 4,178,853 | 12/1979 | Garrison et al. | 102/27 R |

*Primary Examiner*—Peter A. Nelson

*Attorney, Agent, or Firm*—Townsend and Townsend

[57] ABSTRACT

The present invention is an improved detonating cord with flash suppressing properties. In one of its broadest aspects, the invention comprises a detonating cord including a non-extruded coating comprising a halogenated polymer. More particularly, the polymer is included in a wrapped coating such as braid or tape surrounding the explosive core. Preferably the polymer is highly halogenated, the preferred polymers being vinylidene chloride, polytetrafluoroethylene, and polyvinylchloride.

40 Claims, 3 Drawing Figures

DETONATING CORD WITH FLASH-SUPPRESSING COATING

BACKGROUND OF THE INVENTION

1. Field of the Invention

This invention relates to detonating cords with flash suppressing properties.

2. Summary of the Prior Art

Detonating cord is an item of commerce used to transmit a detonation front from one location to another, usually to initiate one or several charges of high explosives. Upon initiation of the cord, a highly exothermic explosion of the core occurs which travels from the point of initiation, the length of the cord, to initiate the explosive charge.

Standard detonating cords normally consist of a high explosive core of particulate pentaerythritol tetranitrate (PETN), occasionally cyclotrimethylenetrinitramine (RDX), trinitrotoluene (TNT), or pentolite (a mixture of TNT and PETN). The core is wrapped in yarns comprised of rayon, acetate or nylon fibers, and sometimes in tapes of polyester, ethylene vinyl acetate or other plastic material. The cord is then extrusion-coated with a plastic material such as polyethylene. Frequently the cord contains further exterior coatings of yarn and wax.

The inner yarns or tapes function to retain the particulate core material in place and are wrapped accordingly. The plastic coating surrounding the cord functions to waterproof the cord (a small amount of water will render PETN non-explosive), strengthen it and facilitate its ease of handling.

Generally, such standard cords are produced by either a "wet process" or a "dry process". In the former process, the explosive core is formed by a slurry of particulate PETN which is passed through a braiding machine to be encased in a braid, and then dried and subsequently coated; in the latter process, the explosive core is formed directly from dry particulate PETN which is encased in tape held closed by a yarn wrap; and subsequently coated as desired.

Where such standard detonating cord is laid through dry vegetation as is frequently the case in seismographic prospecting or clearing fields, the highly exothermic explosion (the "flash") of the core can and has initiated grass and forest fires.

Several approaches have been utilized in an attempt to solve this problem. One such approach includes providing a layer of inorganic salt such as chloride or phosphate salts around the braided or taped core. However, the use of such salts (plus sometimes water of hydration) results in a bulky and difficult-to-handle cord, the volume of salt required usually exceeding the bulk of the core. In addition, the entire length of cord must be carefully inspected to ensure that the coating is in place, a task complicated by the covering used to hold the salt in place.

A second approach is to extrusion-coat the braided or taped core with a halogenated polymer rather than polyethylene, to provide a solid, single-unit coating without breaks in it to suppress the flash. However, in order to extrusion-coat the core safely, temperatures below the melting point of the core (~286° F. in the case of PETN) have to be used. As a result, highly halogenated polymers, such as polyvinyl chloride (PVC) cannot be effectively used; to be safely extrudable a PVC coating has to be diluted to such an extent that it is ineffective. Polymers with a lower degree of halogenation can be used, but the coating has to be relatively thick to be effective; this tends to add to the expense of preparing the cord and reduce its ease of handling. For example, using standard coating machines without modification, the cord generally must be coated twice with the halogenated polymer, in order for the coating to be effective with a core loading of greater than about 35 grains PETN per foot.

Other disadvantages of such halogenated extrusion coatings are that at high summer temperatures, for example, (about 100° F. or more) the coatings frequently soften, deform, and subsequently crack; as a result, the cord may tend to absorb water at the cracks, or may even ignite nearby combustible materials. Also, the coatings have lower tensile strength than the formerly used polyethylene coating. Finally, these halogenated coatings frequently do not evenly and effectively absorb fluoroscent dyes often included as a safety measure to render the cord more visible.

SUMMARY OF THE INVENTION

The present invention is an improved detonating cord with flash suppressing properties of superior effectiveness, which avoids many problems associated with prior flash-suppressing cords. In one of its broadest aspects, the invention comprises a detonating cord having a coating comprising a halogenated polymer which is not applied by extrusion. More particularly, this coating is usually in the form of a wrapped material, usually braid or tape surrounding the explosive core. Despite the fact that these wrapped coatings do not form a solid unitary coating this has been found to provide an effective flash-suppressing coating.

The cord of the present invention has numerous advantages over prior flash suppressing cords. Highly halogenated polymers such as PVC can effectively be used. Also, the cord is effective with even high core loadings without modification of standard equipment, additional processing steps, or reduced handling ease. Additionally, the polyethylene coating used for waterproofing standard cords can be included without increased cord bulk or additional manufacturing steps. Finally, the cord can be produced with the same equipment and with the same number of production steps required for the production of standard detonating cords.

DETAILED DESCRIPTION OF THE SPECIFIC EMBODIMENTS

Standard detonating cord of the prior art is generally produced by one of two methods, the "wet process" and the "dry process." In the wet process, particulate core material is mixed with water, thickeners and flow-promoting chemicals to make a slurry which is no longer cap-sensitive. This slurry is fed into braiding machines which braid yarns around the slurry producing a cylinder of the slurry encased in the yarns. This braided cylinder is then dried. Removing the water renders the core cap-sensitive. The braid can then be coated with a plastic, normally polyethylene, for waterproofing and then optionally other yarns and waxes which provide additional strength and scuff-resistance.

Figure 1:
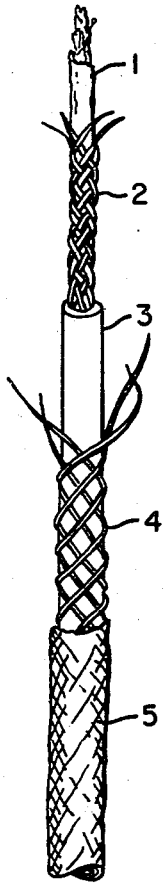
FIG. 1 is an enlarged view of detonating cord prepared according to the "wet process."

FIG. 1 is a schematic drawing of a detonating cord produced according to this wet process. The central portion of the cord consists of the core 1 retained by braided yarns 2 (usually comprised of rayon, nylon, or acetate fiber) surrounding it, and an extruded coating 3 (usually polyethylene) surrounding the braid. In certain prior flash-suppressing cords, this extruded coating 3 contained a halogenated polymer of a moderate degree of halogenation. Countering wraps 4 of similar yarn and an exterior wax coating 5 can also be included.

In the dry process, dry particulate core material is fed into a sheath of plastic or paper tape which has been formed into a tube. The tube is then wrapped with yarn to prevent the tape from opening up and spilling out the core material. A thin yarn is usually fed through the core feed hopper and into the center of the core to promote flow of the core particles into the core. The plastic (polyethylene or a halogenated polymer) coating is then normally extruded around the wrapped cylinder, and exterior yarns and waxes are optionally wrapped around that coating as in the wet process cord.

Figure 2:
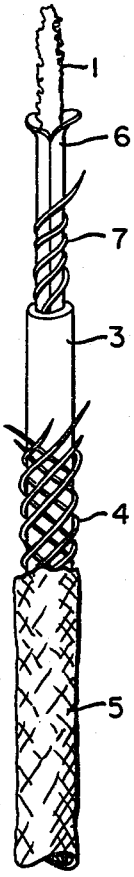
FIG. 2 is an enlarged view of detonating cord prepared according to the "dry process."

FIG. 2 schematically represents a cord prepared according to the dry process, the central core 1 being surrounded by a tape 6 wrapped with yarn 7 and coated with plastic 3. Additional counterwraps 4 and a wax coating 5 can also be included.

In the detonating cord of the present invention, the cord contains a coating comprising a halogenated polymer, which is not applied by extrusion. More particularly, this coating is preferably in the form of wrapped material, usually braid or tape, and most preferably interior to the polyethylene coating, and immediately adjacent to the core. The core is usually of PETN, but in some applications may be RDX, TNT, pentolite or other known explosives.

The halogenated material is a halogenated, usually linear, polymer of virtually any sort, but preferably having a high halogen content. Usually the compound will be either chlorinated or fluorinated.

In the case of chlorinated polymers, the weight percent of chlorine in the polymer can range anywhere up to 85% which represents virtually full substitution with chlorine. Although the halogen content of the polymer can be as low as 25 percent by weight if the coating layer is thick enough to compensate for lowered halogen content, this may detrimentally affect the handling ease of the cord, as well as the time and equipment involved in producing it. It is preferable that the percent chlorine be in the range of 30 to 85% by weight. More preferably, the halogen content should be as high as possible, i.e. in the 60 to 85, usually 70 to 80% by weight range in the case of chlorinated polymers.

Naturally, other ingredients can be included in the wrapped coating in the present invention. Particularly helpful are synergistic agents known in the flame retardant arts, such as antimony trioxide, other antimony compounds, and zinc borohydrate, which are thought to react with halogenated materials generated from the halogenated polymer to aid in inhibiting combustion. Processing aids, fillers, plasticizers and other components can also be included in the tape or yarn.

Where the cord is manufactured by the wet process, the cord will preferably have the schematic configuration shown in FIG. 1, braid 2 comprising the coating of halogenated polymer. Each yarn in the braid is preferably comprised of the halogenated polymer to ensure a flash-suppressant effect. The precise yarn used is selected according to a number of considerations. Where "bulked" yarn (yarn with increased surface area produced by fibrillating or crimping, for example) or multifilament yarn is desired for its improved ability to retain PETN (as in the case of cord with a high core loading), the percent halogenation of the polymer should be as high as practical, and the yarns should comprise minimal inert ingredients.

In the case of unbulked, monofilament yarns, cords with a lower PETN loading will generally require a lower denier yarn than those with higher loadings. Generally, 800–1300 denier yarn is preferable for cords having a loading in the range of 30–40 grains PETN/foot and 1500–2500 denier yarn is preferable for cords having a loading in the vicinity of 40 to 60 usually 50 grains per foot for maximum effectiveness with minimum expense. Usually, the yarn is of a minimum of about 600 deniers, and is woven as tightly as possible into the braid to avoid serious gaps in the braid.

Figure 3:
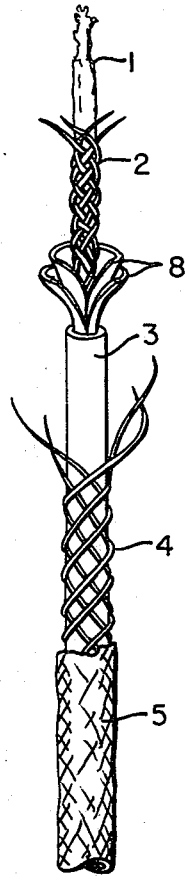
FIG. 3 is a schematic diagram of a detonating cord of the present invention illustrating a third embodiment of the present invention.

In another embodiment of the invention, the wrapping consists of layers of tape. In a cord prepared by the dry process as shown in FIG. 2, tapes 6 are comprised of the halogenated polymer. Alternately, as shown in FIG. 3, tapes (preferably in two layers) can be separately provided exterior to the braided core in a cord prepared by the wet process, although this requires more production steps than conventional cords, and is therefore less desirable. Normally, the tape is comprised primarily of the halogenated polymer, but other components as discussed above can be included as well. The preferred tape consists substantially of polyvinyl vinyl chloride containing about 80% chlorine by weight, or polytetrafluoroethylene.

Alternately, the yarn, tape or the like can be provided exterior to the polyethylene coating of the cord. However, for best results, and for a cord with good handling ease and no additional production steps, the coating will preferably be adjacent the core. In certain cases, for example where the core loadings are relatively high (i.e. above about 60 grains/foot), the extruded coating may in addition be comprised of a halogenated polymer, and/or the yarn and wax exterior to the extruded coating can contain halogenated polymers.

Overall, the cord of the present invention has been found to be extremely effective in providing a detonating cord which will not ignite nearby combustible materials when the cord is detonated, but without the disadvantages of prior flash-suppressing cords.

SPECIFIC EXAMPLES AND TEST RESULTS

The following examples are offered by way of illustration and not by way of limitation. All cords prepared in the examples were prepared by the wet process, unless otherwise indicated.

EXAMPLE 1

A PETN slurry for use in a cord to contain 30 grains PETN/foot was braided with 1,000 denier Saran yarn, utilizing a Wardell 24 carrier braiding machine. Saran is the trademark of Dow Chemical Company for a copolymer containing at least 80% vinylidene chloride, which contains about 75% by weight chlorine. According to available literature, the Saran yarn contains 60–80% chlorine by weight. The braided core was then dried by heated air to contain 30 grains PETN per foot, and was covered with extruded low density polyethylene.

This detonating cord was laid over a pad of dry cotton, ½ inch by 12 inches by 12 inches, which in turn was laid on a steel sheet. A steel grating was laid over the detonating cord to ensure contact between the cord and the cotton. In eight tests in which the cord was detonated, it did not start any fires.

In contrast, a similar cord was made using yarn of 600 denier rayon fibers and 630 denier nylon fibers (both comprised of non-halogenated polymers). In the same type of test, this conventional cord when detonated initiated a fire in the cotton 20 times in 20 tests.

EXAMPLE 2

A detonating cord was prepared as in Example 1, except that 6 of the 24 strands of yarns were comprised of rayon fiber and the remaining 18 strands of yarn comprised of Saran fiber. In the same test as described in Example 1, a fire was initiated in the cotton in each of six trials upon detonation of the cord.

EXAMPLE 3

A detonating cord was made in the same manner as in Example 1 except that 776 denier Saran monofilament yarn was used in place of the yarn mentioned in Example 1. In the same fire test, the detonating cord started no fires in three trials

EXAMPLE 4

A more severe test was devised by passing the detonating cord to be tested over a ½ inch by 12 inch by 12 inch pad of cotton not once but three times by bending it into an elongated S shape with the curved sections being at least six inches outside the edge of the cotton pad. The ends of the cord were at least a foot away from the edges of the cotton pad to eliminate end flash effects and the effect of the blasting cap used to initiate detonation. A heavy metal grating was used to hold the cord in place. In this test, the detonating cord with yarn of Saran fiber of Example 1 started one fire in two trials, the rayon-nylon cord of Example 1 started four fires out of four trials, and the detonating cord of Example 3 started no fires in four trials.

EXAMPLE 5

A four-foot length of 30 grain detonating cord wrapped with rayon-nylon braid as in Example 1 was further wrapped by hand in an overlapping spiral fashion with polytetrafluoroethylene tape, to obtain a tape coating about 0.010 inches thick. This length of detonating cord was then placed on a pad of cotton as described in Example 1. No fire was produced when the cord was detonated.

EXAMPLE 6

A 53.4 grain/foot cord was made with a braid of 1000 denier monofilament Saran yarn using the wet process. The denier of the yarn was insufficient to retain the PETN, as there was obvious PETN dust external to the braid which had passed through gaps in the braid. However, even under these circumstances, in 3 of 5 trials utilizing dry cotton pads as described in Example 1, the pad did not ignite upon detonation of the cord.

EXAMPLE 7

The braided cord of Example 6 was coated with an extruded halogenated coating of vinylidene chloride approximately 0.025–0.030 inches thick. Using the test of Example 4, the cotton pad did not ignite in 5 out of 5 trials.

EXAMPLE 8

A length of 30 grain/foot braided cord of conventional fashion prepared according to the wet process was wrapped by hand with PVC tape in an overlapping spiral fashion to obtain a coating of about 0.014 inches thick. This cord was then subjected to the test of Example 1, and no fires resulted in 3 trials.

Naturally, it will be understood that the above examples and the drawings are intended by way of illustration and not by way of limitation, the scope of the invention being defined by the appended claims.

What is claimed is:

1. In a detonating cord comprising a core of explosive, a wrapped coating retaining said explosive and an extruded coating surrounding said wrapped coating, the improvement which comprises a wrapped coating of a material comprising a halogenated polymer of sufficient halogenation to prevent ignition of nearby external combustible materials upon detonation of the cord.

2. The improvement in a detonating cord according to claim 1 and wherein said explosive is selected from the group consisting of pentaerythritol tetranitrate, cyclotrimethylenetrinitramine, pentolite, and trinitrotoluene.

3. The improvement of claim 2 and wherein said explosive is pentaerythritol tetranitrate.

4. The improvement of claim 2 and wherein said extruded coating is comprised of polyethylene.

5. The improvement of claim 3 and wherein said polymer is selected from the group consisting of fluorinated and chlorinated polymers.

6. The improvement of claim 4 and wherein said wrapped coating of said cord includes yarn braided around and immediately surrounding the explosive core, and wherein said yarn is comprised of said halogenated polymer.

7. The improvement of claim 6 and wherein said yarn is bulked.

8. The improvement of claim 7 and wherein said polymer is chlorinated and comprises about 30–85 percent by weight chlorine.

9. The improvement of claim 8 and wherein said polymer comprises about 60 to 85 percent by weight chlorine.

10. The improvement of claim 9 and wherein said polymer is vinylidene chloride.

11. The improvement of claim 6 and wherein said cord has a loading of less than about 40 grains PETN/foot and the yarn is unbulked monofilament yarn of about 800–1300 deniers.

12. The improvement of claim 6 and wherein said cord has a loading of about 40 to 60 grains PETN/foot and the yarn is unbulked monofilament yarn of about 1500 to 2500 deniers.

13. The improvement of claim 1 and wherein said wrapped coating comprising said polymer comprises tape containing said polymer, said tape wrapped around and surrounding said core interior to said extruded coating.

14. The improvement of claim 13 and wherein said polymer contains about 60 to 85 percent by weight halogen.

15. The improvement of claim 3 and wherein said polymer is selected from the group consisting of polytetrafluoroethylene and polyvinyl chloride.

16. The improvement of claim 2 and wherein said extruded coating is comprised of a halogenated polymer.

17. A detonating cord comprising:

a high explosive core;

a braid of yarn comprised of a halogenated polymer surrounding said core, said polymer having sufficient halogenation to prevent ignition of nearby external combustible materials upon detonation of the cord; and an extruded coating surrounding said braid.

18. A detonating cord according to claim 17 and wherein said explosive is pentaerythritol tetranitrate.

19. A detonating cord according to claim 18 and wherein said polymer is chlorinated and said yarn contains about 60 to 85 percent by weight chlorine.

20. A detonating cord according to claim 19 and wherein said polymer is vinylidene chloride.

21. A detonating cord according to claim 20 and wherein said cord has a core loading of less than about 40 grains/foot PETN and said yarn is unbulked monofilament yarn of about 800–1300 deniers.

22. A detonating cord according to claim 17 and wherein said cord has a core loading of about 40 to 60 grains/foot in said yarn is unbulked monofilament yarn of about 1500–2500 deniers.

23. A detonating cord according to claim 17 and wherein said extruding coating is comprised of low density polyethylene.

24. A detonating cord according to claim 17 and wherein said extruded coating is comprised of a halogenated polymer.

25. A detonating cord comprising:

a high explosive core;

a coating of tape comprising a halogenated polymer wrapped around and surrounding said core and having sufficient halogenation to prevent the cord from igniting nearby combustible materials external to the cord upon detonation of the cord;

an extruded coating external to said tape.

26. A detonating cord according to claim 25 and wherein said explosive is pentaerythritol tetranitrate.

27. A detonating cord according to claim 25 and wherein said polymer is chlorinated or fluorinated.

28. A detonating cord according to claim 27 and having about 60–85 percent by weight halogen.

29. A detonating cord according to claim 22 and wherein said polymer is selected from the group consisting of polytetrafluoroethylene and polyvinylchloride.

30. A detonating cord according to claim 25 and wherein said coating of tape includes two layers of tape.

31. A detonating cord according to claim 25 and further comprising a braid of yarn immediately surrounding said core, and interior to said tape.

32. A detonating cord according to claim 25 and wherein said tape is immediately adjacent the pentaerythritol tetranitrate core.

33. A detonating cord according to claim 25 and wherein said extruded coating is comprised of low density polyethylene.

34. A detonating cord according to claim 25 and wherein said extruded coating is comprised of a halogenated polymer.

35. A detonating cord comprising:

a core of particulate pentaerythritol tetranitrate;

a braid of yarn immediately surrounding said core, said yarn being comprised of vinylidene chloride and having about 60 to 85 weight percent chlorine;

an extruded coating immediately surrounding said braid.

36. A detonating cord according to claim 35 and wherein said extruded coating is comprised of low density polyethylene.

37. A detonating cord according to claim 35 and wherein said extruded coating is comprised of a halogenated polymer.

38. A detonating cord comprising:

a core of pentaerythritol tetranitrate, a braid of yarn immediately surrounding said core;

two layers of tape immediately surrounding said braid, said tape consisting essentially of a halogenated polymer selected from the group consisting of polytetrafluoroethylene and polyvinylchloride;

an extruded coating immediately surounding said tape.

39. A detonating cord according to claim 38 and wherein said extruded coating is comprised of low density polyethylene.

40. A detonating cord according to claim 38 and wherein said extruded coating is comprised of a halogenated polymer.

* * * * *